United States Patent [19]

Nagai

[11] 4,351,632

[45] Sep. 28, 1982

[54] BURNER WITH SUPPRESSED $NO_x$ GENERATION

[75] Inventor: Kiyokazu Nagai, Yao, Japan

[73] Assignee: Chugairo Kogyo Kaisha Ltd., Osaka, Japan

[21] Appl. No.: 136,394

[22] Filed: Apr. 1, 1980

Related U.S. Application Data

[63] Continuation-in-part of Ser. No. 921,172, Jun. 30, 1978, abandoned.

[30] Foreign Application Priority Data

Jul. 1, 1977 [JP] Japan ..... 52-79410

[51] Int. Cl.[3] ..... F23M 9/00

[52] U.S. Cl. ..... 431/183; 431/190; 431/351; 431/353

[58] Field of Search ..... 431/10, 164, 183, 184, 431/187, 188, 190, 351, 353, 4

[56] References Cited

U.S. PATENT DOCUMENTS

| | | | |
|---|---|---|---|
| 2,806,517 | 9/1957 | Te Nuyl | 431/183 |
| 3,132,683 | 5/1964 | Meyer | 431/188 |
| 3,748,080 | 7/1973 | Dunn | 431/190 |
| 3,771,944 | 11/1973 | Hovis et al. | 431/187 |
| 3,910,749 | 10/1975 | Voorheis | 431/353 |
| 3,922,137 | 11/1975 | Peczeli et al. | 31/183 |

*Primary Examiner*—Samuel Scott
*Assistant Examiner*—Lee E. Barrett
*Attorney, Agent, or Firm*—Wenderoth, Lind & Ponack

[57] ABSTRACT

A swirl burner of the two-stage combustion type with suppressed $NO_x$ generation which is so arranged that combustion air supplied into the burner is divided into primary and secondary combustion air, and the primary combustion air subjected to a powerful swirling motion by a primary combustion air nozzle having a frusto-conical shape and swirling vanes is supplied into a primary combustion chamber for drawing only primary combustion gas thereinto, while the secondary air is directed, in the form of a rectilinear flow, into a furnace through secondary combustion air nozzles provided around the primary combustion chamber, with oil and gas for fuel being supplied into the primary combustion chamber through a fuel injector nozzle. Part of the fuel is burned in the primary combustion chamber, while the remainder of the fuel is sequentially mixed with the secondary combustion air for combustion in the furnace.

4 Claims, 9 Drawing Figures

BURNER WITH SUPPRESSED $NO_x$ GENERATION

This application is a continuation-in-part of U.S. patent application Ser. No. 921,172 filed June 30, 1978, now abandoned.

BACKGROUND OF THE INVENTION

The present invention relates to a burner, and more particularly to an improved swirl burner of the two-stage combustion type in which generation of $NO_x$ or nitrogen oxides and soot is suppressed.

Recently, it has been requested as a legal obligation to reduce unburned noxious compounds such as nitrogen oxides, carbon monoxide, hydrocarbon, etc. generated by burners from the viewpoint of pollution prevention.

In order to meet the requirements as described above, there have conventionally been proposed various methods to suppress generation of such noxious compounds, especially nitrogen oxides or $NO_x$, one such method being the so-called two-stage combustion method wherein combustion air to be supplied to the burner is divided into primary combustion air and secondary combustion air. Although the two-stage combustion method as described above is known to be very effective for suppressing the generation of $NO_x$, it has disadvantages in that, when applied to boilers and low temperature furnaces such as petroleum process heaters, etc., flames tend to be excessively long, with a simultaneous increase of the amount of soot in the exhaust gases generated by incomplete combustion. For eliminating such inconveniences, it is necessary to increase the excess rate of combustion air, but such increase is not desirable from the viewpoint of energy saving.

Therefore, development of a low $NO_x$ burner having short flames with a low excess air requirement and yet, having less $NO_x$ and soot generation has been strongly demanded.

Incidentally, the so-called swirl burner, which has been disclosed, for example, in U.S. Pat. No. 3,922,137 entitled "Apparatus for admixing fuel and combustion air", and U.S. Pat. No. 3,852,020 entitled "Method for admixing combustion air in a burner", wherein the combustion air is supplied into the combustion chamber in a swirling or vortex motion through an outer periphery of a fuel nozzle, is extremely effective in the evaporation of the fuel in the combustion chamber, since the flames are caused to swirl in the combustion chamber by the swirling air flow to draw in the combustion gas at its central portion. The known swirl burner as described above, however, still has some points to be improved in the reduction of the excess rate of the combustion air for energy saving, and simultaneous suppression of the amounts of $NO_x$ and soot to be developed.

SUMMARY OF THE INVENTION

Accordingly, an essential object of the present invention is to provide an improved swirl burner of the two-stage combustion type in which amounts of $NO_x$ and soot to be generated are reduced by means of short flames, with a simultaneous reduction of an excess rate of combustion air.

Another important object of the present invention is to provide an improved swirl burner of the above described type which is simple in construction and stable in functioning and can be manufactured at a low cost.

In accomplishing these and other objects, according to one preferred embodiment of the present invention, there is provided a burner with suppressed $NO_x$ generation for use with a furnace in which combustion air is divided into primary combustion air and secondary combustion air for two-stage combustion. The burner comprises:

a housing for maintaining a supply of the combustion air under pressure, having an outer wall and a peripheral wall provided with an inlet of the supply of the combustion air;

a hollow cylindrical member constituting a primary combustion chamber, and contiguous to the peripheral wall of the housing, and having dimensions represented by following equations, $$d_4=217R^{\frac{1}{2}}$$

$$L=368R^{\frac{1}{2}}$$

wherein $d_4$ is the internal diameter in mm of the primary combustion chamber, R is the burner output ($10^6$ kcal/h), and L is the length in mm of the primary combustion chamber;

a plurality of secondary combustion air nozzles provided around and outside the primary combustion chamber in a direction parallel to the axis of the primary combustion chamber for supplying the secondary combustion air into the furnace in the form of rectilinear flow, each of the secondary combustion air nozzles having dimensions represented by, $$d_6=32R^{\frac{1}{2}}$$

wherein $d_6$ is the internal diameter in mm of the secondary combustion nozzle;

a primary combustion air nozzle of a frusto-conical shape coaxially formed in an end wall provided at one end of said primary combustion chamber and narrowed toward said primary combustion chamber, with the primary combustion air nozzle of a frusto-conical shape having dimensions represented by, $$D_2=121R^{\frac{1}{2}}$$

$$170(R+0.25)^{\frac{1}{2}}\leqq D_3\leqq 204(R+0.25)^{\frac{1}{2}}$$

wherein $D_2$ is the minimum diameter in mm of the primary combustion air nozzle of a frusto-conical shape open at the side of the primary combustion chamber and $D_3$ is the large diameter in mm of the primary combustion air nozzle;

a vortex chamber provided between the end wall of the primary combustion chamber and the outer wall of the housing and communicated with the primary combustion air nozzle for subjecting the primary combustion air to a powerful swirling motion so as to introduce the primary combustion air into said primary combustion chamber, with the vortex chamber being defined by a plurality of swirling vanes equally spaced and arranged to form said vortex chamber, and having dimensions represented by, $$141R\leqq I\leqq 196R$$

wherein I is the minimum total inlet area in $cm^2$ between two adjacent blades of the swirling vanes; and a fuel injector nozzle coaxially disposed in the vortex chamber to confront the primary combustion chamber for supplying fuel into the primary combustion air nozzle.

It is to be noted here that, according to the present invention, an allowance of ±10% is provided for each of the dimensions as set forth in the foregoing.

The swirl burner according to the present invention as described above is particularly characterized in that, by the combined effect of the primary combustion air nozzle having a frusto-conical shape and the swirling vanes, powerful swirling of the primary combustion air is achieved in the primary combustion chamber for completing the primary combustion, and that, in the above case, only the primary combustion gas is drawn into the combustion chamber by the swirling, which is different from the arrangements in the conventional burners of a similar kind.

By the arrangement as described above, generation of $NO_x$ and soot, etc. has been advantageously suppressed by means of short flames at a low excess air requirement resulting in a saving in energy, with substantial elimination of the disadvantages inherent in the conventional burners of the two-stage combustion type.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 1:
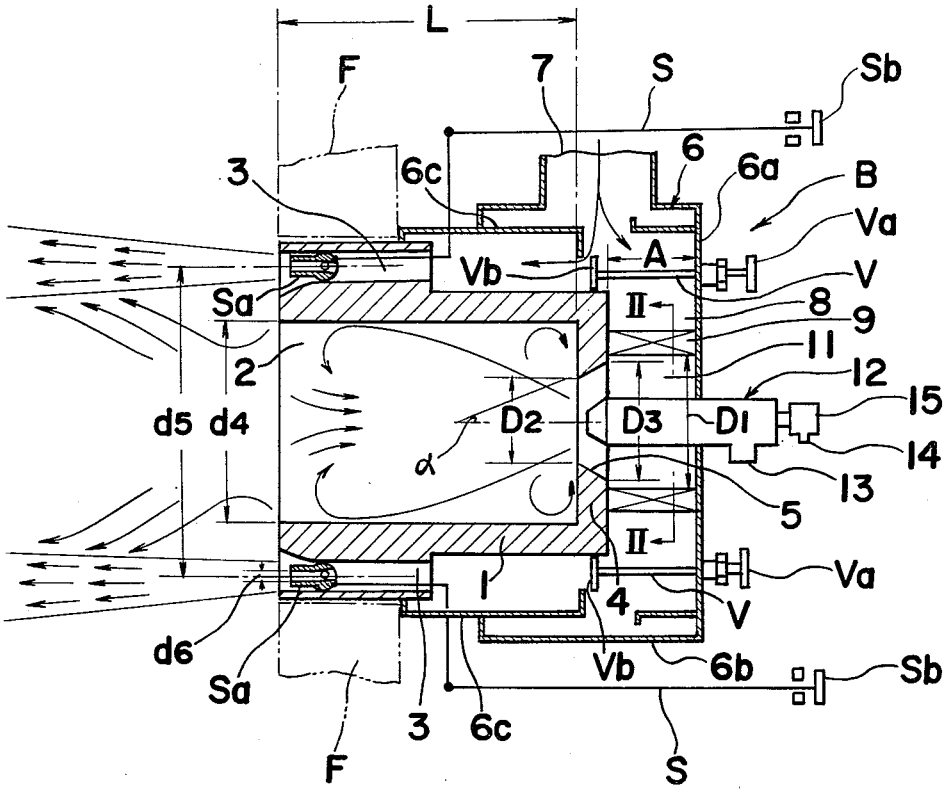
FIG. 1 is a schematic side sectional view of a swirl burner with suppressed $NO_x$ generation according to one preferred embodiment of the present invention.

Referring now to the drawings, there is shown in FIG. 1, a swirl burner B with suppressed $NO_x$ generation according to one preferred embodiment of the present invention which generally includes a primary combustion chamber 2 defined by a hollow cylindrical member 1 having a plurality of nozzles 3 for secondary combustion air which are formed around the outer periphery of the member 1 adjacent to its one open end communicated with an interior of a furnace F (partly shown by a chain line) at the left of the cylindrical member 1 in the drawing, and an end wall 4 provided at the other end of the cylindrical member 1 and having, at a central portion thereof, an air nozzle 5 for the primary combustion air defined by a 45° conical frustum to be gradually narrowed toward the combustion chamber 2.

The swirl burner B further includes a windbox or housing 6 defined by an outer wall 6*a* and a peripheral wall 6*b* having an inlet opening 7 for the primary and secondary air at one part thereof and contiguous, at an edge of the wall 6*b*, to the portion of the cylindrical member 1 whereat the secondary combustion air nozzles 3 are provided, while the outer wall 6*a* of the housing 6 is spaced a distance A from the external surface of the end wall 4 of the cylindrical member 1 so as to form therebetween a passage 8 for the primary combustion air. In the passage 8, there are provided a plurality of arcuate swirling vanes 9 secured to the end wall 4 and the outer wall 6*a* and including, for example, twelve identical rectangular blades 10 equally spaced at intervals of 30° to form a vortex chamber 11 in the inner portion of the swirling vanes 9 as is most clearly seen in FIG. 2.

It is to be noted here that the swirling vanes 9 having the twelve blades 10 as described above have for their object to impart a swirling motion to the primary combustion air for swirling in the combustion chamber 2 of the cylindrical member 1. A fuel injector nozzle 12 extends, through the outer wall 6*a* of the housing 6 and the central portion of the vortex chamber 11, into the primary combustion air nozzle 5 in a coaxial relationship to the latter, and is provided with a fuel gas inlet port 13, a fuel oil inlet port 14 and a spray steam inlet port 15 for atomizing the fuel oil.

Additionally, each of the secondary combustion air nozzles 3 is provided with an air injection angle or air flow direction varying arrangement S which includes a spherical movable member Sa having an air path formed therein to extend forwardly to a certain extent from the member Sa and pivotally accommodated in a forward portion of the nozzle 3 for pivotal movement between a first position whereat the air path is in parallel to the axis of the nozzle 3 and a second position whereat the air path makes a predetermined angle with respect to the axis of the nozzle 3, for example, through a lever mechanism coupled to an operating knob Sb so as to make it possible to control the directions of the secondary combustion air flow through the nozzle 3 from the outside of the burner B. Furthermore, in a position corresponding to each of the secondary combustion air nozzles 3, there is provided on the housing 6 a control device V for controlling the primary and secondary air ratio which includes a valve portion Vb adapted to selectively contact and space from a corresponding edge of a frame 6*c* provided in the housing 6 and a knob Va connected to the valve portion Vb by a rod extending through the space between the end wall 4 and the corresponding wall 6*a* of the housing 6 for manual reciprocation of the valve portion Vb from the outside of the housing 6. The control device S is arranged to control the flow rate of the primary and secondary combustion air so that the percentage of the primary combustion air is kept within the range of 30 to 75%. It should be noted that the confluence or junction of flames is to be adjusted by the flow ratio of the primary combustion air to the secondary combustion air.

By the above arrangement, the combustion air introduced into the burner B through the air inlet opening 7 is divided into the primary combustion air and secondary combustion air, and upon ignition of the fuel gas and atomized fuel oil injected from the fuel injector nozzle 12, the primary combustion air is subjected to a powerful swirling motion by the swirling vanes 9 having the twelve blades 10 as described in detail with reference to FIG. 2 and is discharged into the primary combustion chamber 2 so as to be caused to swirl therein, after once having been formed into a narrow stream by the primary combustion air nozzle 5, while being mixed with the fuel gas, etc. in the vortex chamber 11. In the primary combustion chamber 2, the centrifugal force by the swirling air flow or vortex produces a low pressure portion at the central portion, while at the downstream of the vortex whereat the centrifugal force is considerably small, part of the primary combustion gas is drawn into the central portion as shown by the arrows in FIG. 1. Meanwhile, the swirling flow discharged into the combustion chamber 2 after once having been formed into the narrow stream by the primary combustion air nozzle 5 as described earlier, produces low pressure portions at corner portions thereof to attract part of the primary combustion gas in the similar manner as stated above.

It should be noted here that, owing to a synergistic effect of the primary combustion air nozzle 5 having a frusto-conical shape and the swirling vanes 9, powerful swirling of the primary combustion air is achieved in the primary combustion chamber 2 for completion of the primary combustion. It should also be noted particularly that, in the above case, only the primary combustion gas is involved or drawn into the combustion chamber 2 by the swirling. More specifically, evaporation of the fuel is accelerated by the temperature of the primary combustion gas drawn in the above described manner, with part of the fuel being burned, and the swirling force is maintained even after subsequent entry of the rest of the fuel into the furnace F. In other words, in the above case, the remainder of the fuel is sequentially mixed with the rectilinear air flow from the secondary combustion air nozzles 3 for combustion, during which time, short flames can be obtained with favorable burning by reducing the rectilinear advancing force of the secondary combustion air through proper utilization of the swirling force. The amount of the primary combustion air is in the region of 30 to 75% with respect to the total amount of the combustion air.

Figure 3:
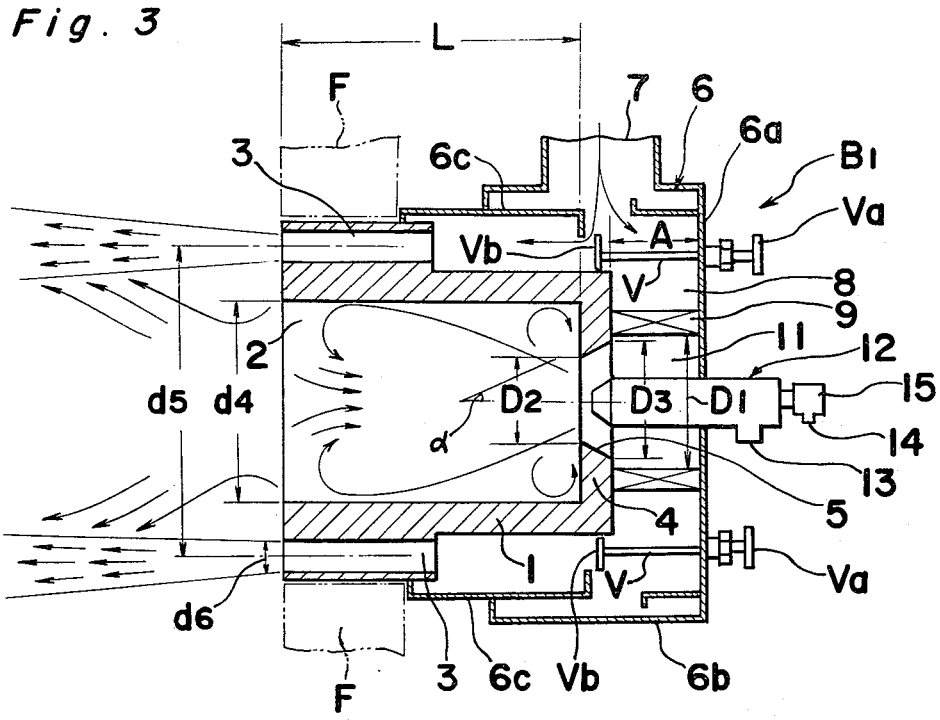
FIG. 3 is a view similar to FIG. 1, which particularly shows a modification thereof.
Figure 4:
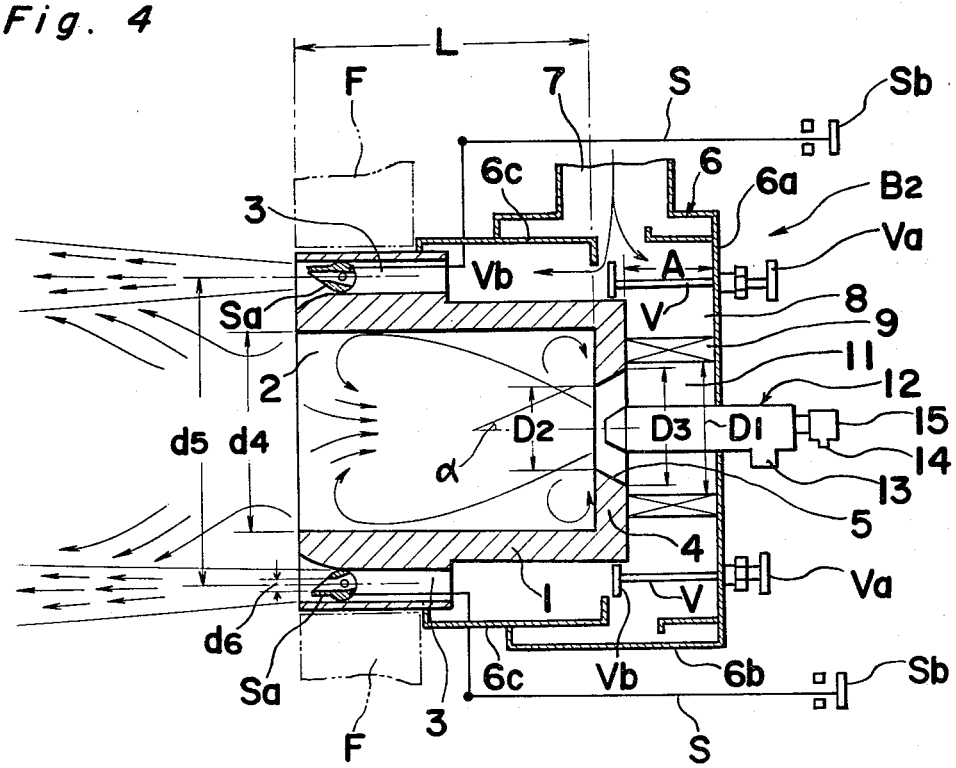
FIG. 4 is a view similar to FIG. 1, which particularly shows a further modification thereof.

Referring to FIGS. 3 and 4 showing modifications of the swirl burner B of FIG. 1, in the modified swirl burner B1 of FIG. 3, the spherical movable members Sa of the air flow direction varying arrangement S described as pivotally accommodated in the nozzles 3 for controlling the direction of the secondary combustion air flow through the nozzle 3 in the arrangement of FIG. 1 is dispensed with together with the air flow direction varying arrangement S, and in the above case, although not illustrated in FIG. 3, the tapering or cutting adjacent to the forward end portion of each nozzle 3 shown in FIG. 1 may be left as it is or dispensed with as in FIG. 3. Similarly, as shown in another modified swirl burner B2 of FIG. 4, each of the air path extending forwardly to a certain extent from the spherical member Sa may be cut slantwise at an angle at its forward end.

As is seen from the foregoing description, when the swirling burner is employed, efficient evaporation of the fuel can be expected, since the mixed swirling flow draws the primary combustion gas into the central portion of the primary combustion chamber as it swirls, to raise the temperature thereat, and thus, even when the amount of the primary combustion air is smaller than that in two-stage burners of different types, that is to say, even if the excess air rate is low on the whole, it is possible to achieve short flames, with a small amount of soot, while simultaneously, generation of $NO_x$ is advantageously suppressed.

Figure 2:
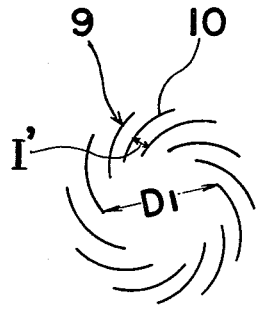
FIG. 2 is a cross sectional view of swirling inlet vanes employed in the swirl burner, taken along the line II—II in FIG. 1.

Incidentally, according to the experiments carried out by the present inventors on the swirling burner as shown in FIGS. 1 and 2, it has been found that there are certain restrictions in the internal diameters of the swirling vanes 9, primary combustion air nozzle 5, and primary combustion chamber 2, size of the secondary combustion air nozzle 3, etc. as represented by the following equations, with an allowance of ±10% for each of the dimensions.

$$D_2 = 121R^{\frac{1}{2}}$$

where R is the burner output ($10^6$ Kcal/h) and $D_2$ is the minimum diameter in mm of the primary combustion air nozzle 5 of a frusto-conical shape open at the side of the primary combustion chamber 2, $$170(R+0.25)^{\frac{1}{2}} \leqq D_3 \leqq 204(R+0.25)^{\frac{1}{2}}$$

where $D_3$ is the diameter in mm of the primary combustion air nozzle 5 open at the side of the vortex chamber 11, $$D_1 = 1.05D_3$$

where $D_1$ is the inner diameter in mm of a cylindrical portion, surrounded by the blades 10 of the swirling vanes 9, $$A = 136(R+0.25)^{\frac{1}{2}}$$

where A is the distance in mm between the external surface of the end wall 4 of the cylinder member 1 and the outer wall 6*a* of the housing 6 as mentioned earlier, $$\alpha = 45°$$

where $\alpha$ is a conical angle of the primary combustion air nozzle 5 as measured with respect to the central axis of the nozzle 5, $$141R \leqq I \leqq 196R$$

where I is the minimum total inlet area between two adjacent blades 10 of the swirling vanes 9 ($cm^2$)

$$I = I' \times A \times 10^{-2} = 136(R+0.25)^{\frac{1}{2}} \times I'$$

where I' is the minimum distance in mm between the neighboring blades 10 of the swirling vanes 9, $$d_4 = 217R^{\frac{1}{2}}$$

where $d_4$ is the internal diameter in mm of the primary combustion chamber 2, $$L = 368R^{\frac{1}{2}}$$

$$L = 1.7d_4$$

where L is the length in mm of the primary combustion chamber 2, $$d_5 = 328R^{\frac{1}{2}}$$

where $d_5$ is the diameter in mm of a pitch circle for the secondary combustion air nozzles 3, $$d_6 = 32R^{\frac{1}{2}}$$

where $d_6$ is the internal diameter in mm of each of the secondary combustion air nozzles 3, and $$n = 3 + R^{\frac{1}{3}}$$

where n is the number of the secondary combustion air nozzles 3.

In connection with the above, the dimensional ratio of the primary combustion chamber represented by, $$\frac{d_4}{L} = \frac{217}{368} \approx \frac{10}{17}$$

is particularly advantageous in that the primary combustion is perfectly effected, and that, even upon addition of the secondary air, complete combustion is achieved without formation of soots and the like due to incomplete combustion.

In the foregoing dimensional restrictions according to the present invention, although the diameter $d_5$ of the pitch circle for the secondary combustion air nozzles 3 is variable, the dimensions of the secondary combustion air nozzle 3, i.e. the above diameter $d_5$, and the internal diameter $d_6$ of each of the secondary combustion air nozzles 3 are restricted, since the allowance of ±10% is provided for each of the dimensions as described in the foregoing, and thus, the variation may be effected within said allowance of ±10%.

Figure 5:
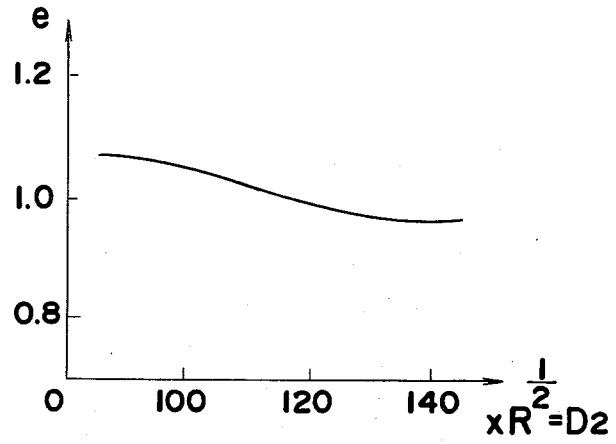
FIGS. 5 to 9 are graphs explanatory of the performance of the swirl burner according to the present invention in comparison with that of conventional swirl burners.
Figure 6:
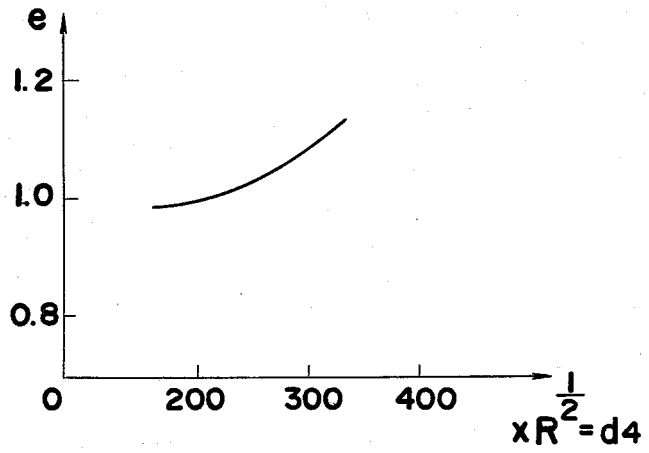
Figure 7:
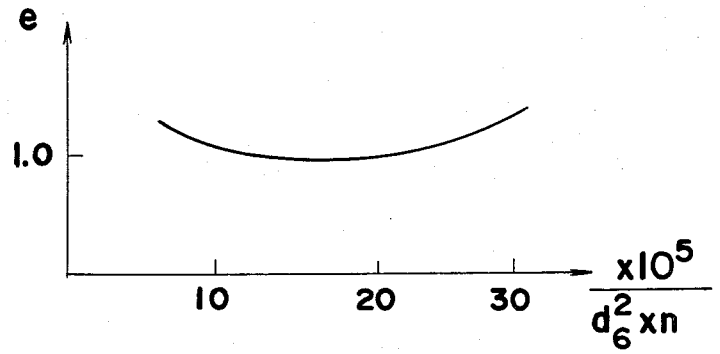

Referring also to FIGS. 5 to 7 showing graphs explanatory of variations of NO formation amount, in which the ratio e of NO formation amount of burners having different dimensions from the burner of the present invention to NO formation amount of the burner having dimensions according to the present invention is taken as the ordinate and the dimensions of the same are taken as abscissa, it is noticed that the difference in the variations in the NO formation amount is small within the allowable dimensional tolerance of ±10%. In other words, in the range as described above, difference in effects was hardly noticeable, while the variations in the flame length were also trivial, with the minimum difference in effect with respect to the generation of soot.

In the graphs of FIGS. 5 to 7, the ratio e is represented by $e = \frac{\text{NO formation amount of burners having different dimensions from the burner of the present invention}}{\text{NO formation amount of the burner having dimensions according to the present invention}}$ and the amount of the primary combustion air is equal to the amount of the secondary combustion air.

Figure 8:
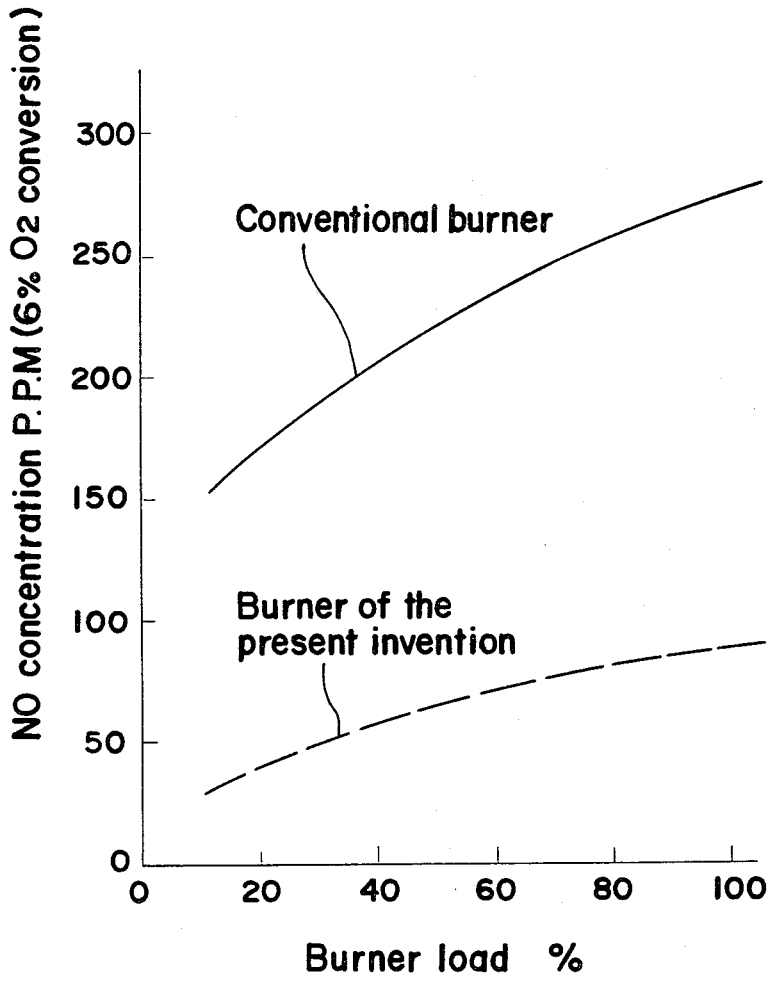

Referring to FIG. 8, in another experiment in which the swirl burner having dimensions as described above according to the present invention and a conventional swirl burner were subjected to a comparative combustion test with the use of C heavy oil (N=0.22 wt.%) at a combustion air excess rate of 1.02 to 1.05, the burner with suppressed $NO_x$ generation according to the present invention had extremely small generation of $NO_x$ at 80 P.P.M. ($O_2$=1%, 6% $O_2$ conversion), and moreover, generation of the soot was negligible, with short flames obtained regardless of the fact that the remaining $O_2$ was in the region of 0.1 to 0.5%.

Figure 9:
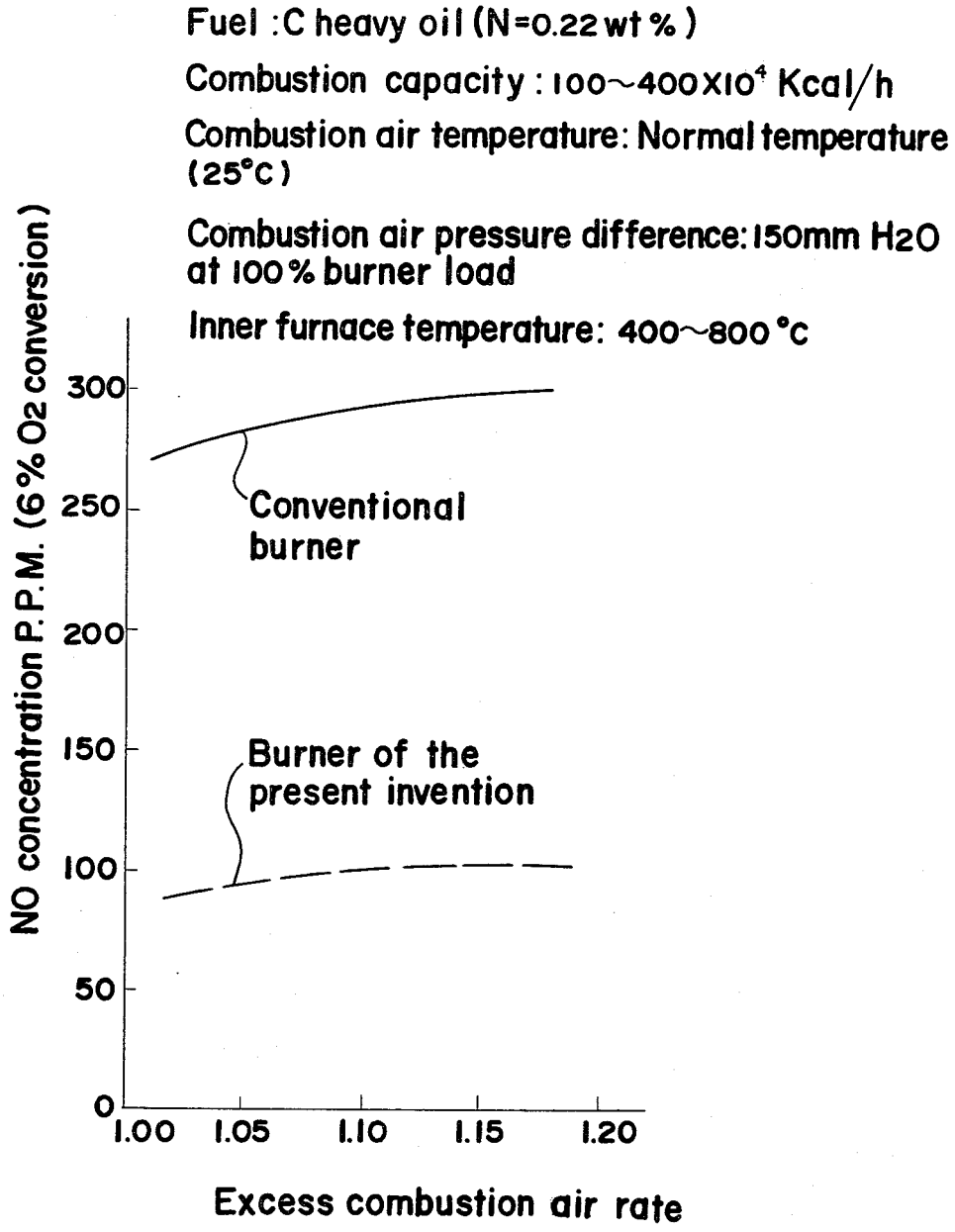

In a further experiment, the result of which is given in the graph of FIG. 9, even when the combustion air excess rate was altered in the range from 1.02 to 1.15 or when the combustion air temperature was varied in the range from the normal temperature to a temperature of 200° C., almost no variations were noticed in the favorable performance of the burner according to the present invention as described above.

As is clear from the foregoing description, according to the present invention, the disadvantages of the conventional two-stage combustion arrangements as means for suppressing $NO_x$, i.e., the tendency to long flames and increase of the amount of soot, can be advantageously suppressed at low excess air requirement, with consequent saving in energy.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A burner with suppressed $NO_x$ generation for use with a furnace in which combustion air is divided into primary combustion air and secondary combustion air for two-stage combustion, said burner comprising;

a housing for maintaining a supply of the combustion air under pressure, said housing having an outer wall and a peripheral wall provided with an inlet of the supply of the combustion air;

a hollow cylindrical member constituting a primary combustion chamber, and contiguous to said peripheral wall of said housing, said primary combustion chamber having dimensions represented by the following equations, $$d_4 = 217R^{\frac{1}{2}}$$

$$L = 368R^{\frac{1}{2}}$$

wherein $d_4$ is the internal diameter in mm of the primary combustion chamber, R is the burner output ($10^6$ Kcal/h), and L is the length in mm of the primary combustion chamber;

a plurality of secondary combustion air nozzles provided around and outside said primary combustion chamber in a direction parallel to the axis of said primary combustion chamber and operatively connected to said housing for supplying the secondary combustion air into the furnace in the form of a rectilinear flow, said secondary combustion air nozzles each having dimensions represented by, $$d_6 = 32R^{\frac{1}{2}}$$

where $d_6$ is the internal diameter in mm of each of the secondary combustion nozzles;

a primary combustion air nozzle of a frusto-conical shape coaxially formed in an end wall provided at one end of said primary combustion chamber and narrowed toward said primary combustion chamber, said primary combustion air nozzle of a frusto-conical shape having dimensions represented by, $$D_2 = 121R^{\frac{1}{2}}$$

$$170(R+0.25)^{\frac{1}{2}} \leqq D_3 \leqq 204(R+0.25)^{\frac{1}{2}}$$

wherein $D_2$ is the minimum diameter in mm of the primary combustion air nozzle of a frusto-conical shape open at the side of the primary combustion chamber and $D_3$ is the large diameter in mm of the primary combustion air nozzle open at the side of a vortex chamber;

said vortex chamber being provided between said end wall of said primary combustion chamber and said outer wall of said housing and communicated with said primary combustion air nozzle for imparting a powerful swirling motion to the primary combustion air so as to introduce the primary combustion air into said primary combustion chamber, said vortex chamber being defined by a plurality of swirling vanes equally spaced and arranged to form said vortex chamber, and having dimensions represented by, $$141R < I < 196R$$

wherein I is the minimum total inlet area in $cm^2$ between two adjacent blades of the swirling vanes; and a fuel injector nozzle coaxially disposed in said vortex chamber to confront said primary combustion chamber for supplying fuel into said primary combustion air nozzle.

2. A burner with suppressed $NO_x$ generation as claimed in claim 1, wherein said secondary combustion air nozzles are each provided with means for varying directions of flow of the secondary combustion air.

3. A burner with suppressed $NO_x$ generation as claimed in claim 1, further including air ratio control means provided in positions corresponding to said secondary combustion air nozzles for controlling their flow rate, wherein the ratio of the primary combustion air to the secondary combustion air is controlled such that the percentage of the primary combustion air is in the range of from 75 to 30%.

4. A burner with suppressed $NO_x$ generation for use with a furnace in which combustion air is divided into primary combustion air and secondary combustion air for two-stage combustion, said burner comprising;

a housing for maintaining a supply of the combustion air under pressure, said housing having an outer wall and a peripheral wall provided with an inlet of the supply of the combustion air;

a hollow cylindrical member constituting a primary combustion chamber, and contiguous to said peripheral wall of said housing;

a plurality of secondary combustion air nozzles provided around and outside said primary combustion chamber in a direction parallel to the axis of said primary combustion chamber for supplying the secondary combustion air into the furnace in the form of a rectilinear flow;

a primary combustion air nozzle of a frusto-conical shape coaxially formed in an end wall provided at one end of said primary combustion chamber and narrowed toward said primary combustion chamber;

a vortex chamber provided between said end wall of said primary combustion chamber and said outer wall of said housing and communicated with said primary combustion air nozzle for imparting a powerful swirling motion to the primary combustion air so as to introduce the primary combustion air into said primary combustion chamber; and a fuel injector nozzle coaxially disposed in said vortex chamber to confront said primary combustion chamber for supplying fuel into said primary combustion air nozzle;

said burner having dimensions represented by following equations within an allowance of ±10%, $$D_1 = 1.05D_3$$

$$A = 136(R+0.25)^{\frac{1}{2}}$$

$$\alpha = 45°$$

$$d_5 = 328R^{\frac{1}{2}}$$

$$d_6 = 32R^{\frac{1}{2}}$$

$$n = 3 + R^{\frac{1}{3}}$$

wherein:

$D_1$ = Internal diameter of a cylindrical portion surrounded by a plurality of blades of a plurality of swirling vanes in mm, $D_3$ = Large diameter of conical frustum for primary combustion air nozzle in mm, A = Distance between end wall of primary combustion air chamber and outer wall of housing in mm, $\alpha$—Conical angle of primary combustion air nozzle as measured with respect to axial line, R = Burner output ($10^6$ Kcal/h), $d_5$ = Pitch circle diameter of secondary combustion air nozzle in mm, $d_6$ = Internal diameter of secondary combustion nozzle in mm, and n = Number of secondary combustion air nozzles.

* * * * *